US007880407B2

(12) United States Patent
Fang et al.

(10) Patent No.: US 7,880,407 B2
(45) Date of Patent: Feb. 1, 2011

(54) DRIVER SYSTEM AND METHOD WITH CYCLIC CONFIGURATION FOR MULTIPLE COLD-CATHODE FLUORESCENT LAMPS AND/OR EXTERNAL-ELECTRODE FLUORESCENT LAMPS

(75) Inventors: Lieyi Fang, Shanghai (CN); Changshan Zhang, Shanghai (CN); Zhiliang Chen, Shanghai (CN); Shifeng Zhao, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 884 days.

(21) Appl. No.: 11/450,904

(22) Filed: Jun. 8, 2006

(65) Prior Publication Data

US 2007/0273297 A1 Nov. 29, 2007

(30) Foreign Application Priority Data

May 26, 2006 (CN) ..... 2006 1 0027052

(51) Int. Cl.
*H05B 37/00* (2006.01)
*H05B 41/16* (2006.01)

(52) U.S. Cl. ..... 315/312; 315/277

(58) Field of Classification Search ..... 315/312, 315/274, 275, 277, 278, 279, 280
See application file for complete search history.

(56) References Cited

U.S. PATENT DOCUMENTS 6,121,734 A 9/2000 Szabados
6,559,606 B1 5/2003 Chou et al.
6,717,372 B2 * 4/2004 Lin et al. ..... 315/282
6,781,325 B2 * 8/2004 Lee ..... 315/282
7,061,183 B1 6/2006 Ball
7,075,248 B2 * 7/2006 Hsieh et al. ..... 315/277
7,141,933 B2 * 11/2006 Ball ..... 315/57
7,166,969 B2 1/2007 Kohno
7,190,123 B2 * 3/2007 Lee ..... 315/224
7,242,151 B2 7/2007 Chan et al.
7,309,964 B2 * 12/2007 Wey et al. ..... 315/312

(Continued)

OTHER PUBLICATIONS

Great Chip, ZAULas (Zip As UniLamp System), "New Inverter Technology for Big Size LCD Backlight," FPD International 2004 Seminar Speech, Apr. 7, 2004, downloaded from the Internet <<http://www.greatchip.com.tw/upload_data/b5-e.pdf>>.

(Continued)

*Primary Examiner*—Douglas W Owens
*Assistant Examiner*—Minh D A
(74) *Attorney, Agent, or Firm*—Jones Day

(57) ABSTRACT

System and method for driving a plurality of cold-cathode fluorescent lamps. The system includes a subsystem configured to receive at least a DC voltage and generate a first AC voltage in response to at least the DC voltage, a power converter configured to receive the first AC voltage and convert the first AC voltage to at least a second AC voltage, and a plurality of current balancing devices. Each of the plurality of current balancing devices is configured to receive two currents and balance the two currents. The power converter and the plurality of current balancing devices are capable of being directly or indirectly coupled to a plurality of cold-cathode fluorescent lamps.

14 Claims, 7 Drawing Sheets

U.S. PATENT DOCUMENTS

| | | | | |
|---|---|---|---|---|
| 7,319,297 | B2 | 1/2008 | Kuo | |
| 7,402,957 | B2 | 7/2008 | Shimura et al. | |
| 7,425,949 | B2 * | 9/2008 | Lin et al. | 345/211 |
| 2005/0093472 | A1 * | 5/2005 | Jin | 315/177 |
| 2005/0093484 | A1 | 5/2005 | Ball | |
| 2005/0212790 | A1 | 9/2005 | Lin et al. | |
| 2005/0225261 | A1 | 10/2005 | Jin | |

OTHER PUBLICATIONS

Jin, "Backlight Design for large LCD TV Screens," Vido Image Line, Jan. 2, 2006, downloaded from Internet <<http://www.videsign/howto/showArticle.jhtml?ArticleId=175800309>> on May 4, 2006, 8 pages.

United States Patent and Trademark Office, Notice of Allowance for U.S. Appl. No. 11/872,604, mailed Feb. 24, 2010.

* cited by examiner

DRIVER SYSTEM AND METHOD WITH CYCLIC CONFIGURATION FOR MULTIPLE COLD-CATHODE FLUORESCENT LAMPS AND/OR EXTERNAL-ELECTRODE FLUORESCENT LAMPS

CROSS-REFERENCES TO RELATED APPLICATIONS

This application claims priority to Chinese Patent Application No. 200610027052.3, filed May 26, 2006, titled "Driver System and Method with Cyclic Configuration for Multiple Cod-Cathode Fluorescent Lamps and/or External-Electrode Fluorescent Lamps," by inventors Lieyi Fang, Changshan Zhang, Zhiliang Chen, and Shifeng Zhao, commonly assigned, incorporated by reference herein for all purposes.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention is directed to integrated circuits. More particularly, the invention provides a system and method with cyclic configuration. Merely by way of example, the invention has been applied to driving multiple cold-cathode fluorescent lamps, and/or external-electrode fluorescent lamps. But it would be recognized that the invention has a much broader range of applicability.

The cold-cathode fluorescent lamp (CCFL) and external-electrode fluorescent lamp (EEFL) have been widely used to provide backlight for a liquid crystal display (LCD) module. The CCFL and EEFL often each require a high alternate current (AC) voltage such as 2 kV for ignition and normal operation. Such a high AC voltage can be provided by a CCFL driver system or an EEFL driver system. The CCFL driver system and the EEFL driver system each receive a low direct current (DC) voltage and convert the low DC voltage to the high AC voltage.

FIG. 1 is a simplified conventional driver system for CCFL and/or EEFL. The driver system 100 includes a control subsystem 110 and an AC power supply subsystem 120. The control subsystem 110 receives a power supply voltage $V_{DDA}$ and certain control signals. The control signals include an enabling (ENA) signal and a dimming (DIM) signal. In response, the control subsystem 110 outputs gate drive signals to the AC power supply subsystem 120. The AC power supply subsystem 120 includes one or more MOSFET transistors and one or more power transformers, and receives a low DC voltage $V_{IN}$. The MOSFET transistors convert the low DC voltage $V_{IN}$ to a low AC voltage in response to the gate drive signals. The low AC voltage is boosted to a high AC voltage $V_{OUT}$ by the power transformers, and the high AC voltage $V_{OUT}$ is sent to drive a system 190. The system 190 includes one or more CCFLs and/or one or more EEFLs. The system 190 provides a current and voltage feedback to the control subsystem 110.

As shown in FIG. 1, the system 190 includes one or more CCFLs and/or one or more EEFLs. These lamps can be used to provide backlight for an LCD panel. For a large LCD panel, a single-lamp backlight module often cannot provide sufficient backlighting. Consequently, a multi-lamp backlight module often is needed. For example, an LCD panel may require 20 to 40 lamps in order to provide high-intensity illumination for displaying full motion videos. From these lamps, the individual currents need to be balanced in order to maintain the display uniformity. For example, the current difference between different lamps should be maintained within a reasonable tolerance.

To balance lamp currents, some conventional techniques have been developed. For example, the conventional techniques use impedance matching schemes to build a balance controller for equalizing lamp currents. In another example, the conventional techniques use one or more common-mode chokes, which can balance the lamp currents. But these conventional systems can have various weaknesses in terms of flexibility, stability, and/or simplicity.

Hence it is highly desirable to improve techniques for multi-lamp driver system for CCFLs and/or EEFLs.

BRIEF SUMMARY OF THE INVENTION

The present invention is directed to integrated circuits. More particularly, the invention provides a system and method with cyclic configuration. Merely by way of example, the invention has been applied to driving multiple cold-cathode fluorescent lamps, and/or external-electrode fluorescent lamps. But it would be recognized that the invention has a much broader range of applicability.

According to one embodiment of the present invention, a system for driving a plurality of cold-cathode fluorescent lamps includes a subsystem configured to receive at least a DC voltage and generate a first AC voltage in response to at least the DC voltage, a power converter configured to receive the first AC voltage and convert the first AC voltage to at least a second AC voltage, and a plurality of current balancing devices. Each of the plurality of current balancing devices is configured to receive two currents and balance the two currents. The power converter and the plurality of current balancing devices are capable of being directly or indirectly coupled to a plurality of cold-cathode fluorescent lamps. For each of the plurality of cold-cathode fluorescent lamps, each of the plurality of cold-cathode fluorescent lamps is associated with a lamp current, and the plurality of cold-cathode fluorescent lamps includes at least a first lamp and a second lamp. Both the first lamp and the second lamp are different from the each of the plurality of cold-cathode fluorescent lamps. The first lamp and the second lamp are associated with a first current and a second current respectively. Additionally, a first current balancing device selected from the plurality of current balancing devices is configured to receive the lamp current and the first current and to balance the lamp current and the first current, and a second current balancing device selected from the plurality of current balancing devices is configured to receive the lamp current and the second current and to balance the lamp current and the first current.

According to another embodiment of the present invention, a system for driving a plurality of cold-cathode fluorescent lamps includes a subsystem configured to receive at least a DC voltage and generate a first AC voltage in response to at least the DC voltage, a power converter configured to receive the first AC voltage and convert the first AC voltage to at least a second AC voltage, and a plurality of current balancing devices. Each of the plurality of current balancing devices is configured to receive two currents and balance the two currents. The power converter and the plurality of current balancing devices are capable of being directly or indirectly coupled to a first plurality of cold-cathode fluorescent lamps. The first plurality of cold-cathode fluorescent lamps includes a second plurality of cold-cathode fluorescent lamps and a third lamp, and the third cold-cathode fluorescent lamp is associated with a first current. For each of the second plurality of cold-cathode fluorescent lamps, each of the second plurality of cold-cathode fluorescent lamps is associated with a lamp current, and the second plurality of cold-cathode fluorescent lamps includes at least a fourth lamp. The fourth lamp is different from the each of the second plurality of cold-cathode fluorescent lamps and is associated with a second current. Additionally, a first current balancing device selected from the plurality of current balancing devices is configured to receive the lamp current and the second current and to balance the lamp current and the second current. Moreover, if the second plurality of cold-cathode fluorescent lamps further includes a fifth lamp which is different from the each of the second plurality of cold-cathode fluorescent lamps and is associated with a third current, a second current balancing device selected from the plurality of current balancing devices is configured to receive the lamp current, and the first current or the third current, and is further configured to balance the lamp current, and first current or the third current.

According to yet another embodiment of the present invention, a system for driving a plurality of cold-cathode fluorescent lamps includes a subsystem configured to receive at least a DC voltage and generate a first AC voltage in response to at least the DC voltage, a power converter configured to receive the first AC voltage and convert the first AC voltage to at least a second AC voltage, and a plurality of current balancing devices. Each of the plurality of current balancing devices is configured to receive two currents and balance the two currents. The power converter and the plurality of current balancing devices are capable of being directly or indirectly coupled to a plurality of cold-cathode fluorescent lamps. For each of the plurality of cold-cathode fluorescent lamps, each of the plurality of cold-cathode fluorescent lamps is associated with a first lamp current and a second lamp current, and the plurality of cold-cathode fluorescent lamps includes at least a first lamp and a second lamp. Both the first lamp and the second lamp are different from the each of the plurality of cold-cathode fluorescent lamps. The first lamp and the second lamp are associated with a third lamp current and a fourth lamp current respectively. Additionally, a first current balancing device selected from the plurality of current balancing devices is configured to receive the first lamp current and the third lamp current and to balance the first lamp current and the third lamp current, and a second current balancing device selected from the plurality of current balancing devices is configured to receive the second lamp current and the fourth lamp current and to balance the second lamp current and the fourth lamp current.

According to yet another embodiment, a method for driving a plurality of cold-cathode fluorescent lamps includes receiving at least a DC voltage, generating a first AC voltage in response to at least the DC voltage, receiving the first AC voltage, converting the first AC voltage to at least a second AC voltage, and driving a plurality of cold-cathode fluorescent lamps with at least the second AC voltage. For each of the plurality of cold-cathode fluorescent lamps, each of the plurality of cold-cathode fluorescent lamps is associated with a lamp current, and the plurality of cold-cathode fluorescent lamps includes at least a first lamp and a second lamp. Both the first lamp and the second lamp are different from the each of the plurality of cold-cathode fluorescent lamps, and the first lamp and the second lamp are associated with a first current and a second current respectively. Additionally, for the each of the plurality of cold-cathode fluorescent lamps, the method includes receiving the lamp current and the first current, balancing the lamp current and the first current, receiving the lamp current and the second current, and balancing the lamp current and the first current.

According to yet another embodiment, a method for driving a plurality of cold-cathode fluorescent lamps includes receiving at least a DC voltage, generating a first AC voltage in response to at least the DC voltage, receiving the first AC voltage, converting the first AC voltage to at least a second AC voltage, and driving a first plurality of cold-cathode fluorescent lamps with at least the second AC voltage. The first plurality of cold-cathode fluorescent lamps includes a second plurality of cold-cathode fluorescent lamps and a third lamp, and the third cold-cathode fluorescent lamp is associated with a first current. For each of the second plurality of cold-cathode fluorescent lamps, each of the second plurality of cold-cathode fluorescent lamps is associated with a lamp current, and the second plurality of cold-cathode fluorescent lamps includes at least a fourth lamp, which is different from the each of the second plurality of cold-cathode fluorescent lamps and is associated with a second current. Additionally, for the each of the second plurality of cold-cathode fluorescent lamps, the method includes receiving the lamp current and the second current, and balancing the lamp current and the second current. Moreover, if the second plurality of cold-cathode fluorescent lamps further includes a fifth lamp, which is different from the each of the second plurality of cold-cathode fluorescent lamps and is associated with a third current, the method includes receiving the lamp current, and the first current or the third current, and balancing the lamp current, and first current or the third current.

According to yet another embodiment, a method for driving a plurality of cold-cathode fluorescent lamps includes receiving at least a DC voltage, generating a first AC voltage in response to at least the DC voltage, receiving the first AC voltage, converting the first AC voltage to at least a second AC voltage, and driving a plurality of cold-cathode fluorescent lamps with at least the second AC voltage. For each of the plurality of cold-cathode fluorescent lamps, each of the plurality of cold-cathode fluorescent lamps is associated with a first lamp current and a second lamp current, and the plurality of cold-cathode fluorescent lamps includes at least a first lamp and a second lamp. Both the first lamp and the second lamp are different from the each of the plurality of cold-cathode fluorescent lamps, and the first lamp and the second lamp are associated with a third lamp current and a fourth lamp current respectively. Additionally, for the each of the plurality of cold-cathode fluorescent lamps, the method includes receiving the first lamp current and the third lamp current, balancing the first lamp current and the third lamp current, receiving the second lamp current and the fourth lamp current, and balancing the second lamp current and the fourth lamp current.

Many benefits are achieved by way of the present invention over conventional techniques. For example, some embodiments of the present invention provide a driver system that can balance currents between or among any number of lamps. Certain embodiments of the present invention provide a configuration in which only one or two inductive windings are in series with each lamp between the secondary winding of the transformer and the ground voltage. For example, the one or two inductive windings belong to one or two current balance chokes respectively. In another example, the currents flowing through at least majority of the lamps go through same types of circuit components. Some embodiments of the present invention provide great flexibility to the design and manufacturing of multi-lamp driver system. Certain embodiments of the present invention can improve stability and reliability of a multi-lamp driver system. Some embodiments of the present invention can simplify processes and lower costs for making a multi-lamp driver system. Certain embodiments of the present invention can balance both the currents flowing into some lamps and the currents flowing out of certain lamps. Some embodiments of the present invention can improve current balancing of a multi-lamp driver system by eliminating or reducing adverse effects by stray conductance or parasitic capacitance of the lamps. Certain embodiments of the present invention can provide current balancing to lamps driven by different transformers using cyclic current balance schemes. Some embodiments of the present invention can improve brightness uniformity on an LCD screen lit by a plurality of lamps that are driven by one or more transformers. Depending upon the embodiment, one or more of these benefits may be achieved. These and other benefits will be described in more detail throughout the present specification and more particularly below.

Various additional objects, features and advantages of the present invention can be more fully appreciated with reference to the detailed description and the accompanying drawings that follow.

DETAILED DESCRIPTION OF THE INVENTION

The present invention is directed to integrated circuits. More particularly, the invention provides a system and method with cyclic configuration. Merely by way of example, the invention has been applied to driving multiple cold-cathode fluorescent lamps, and/or external-electrode fluorescent lamps. But it would be recognized that the invention has a much broader range of applicability.

For multiple cold-cathode fluorescent lamps and/or external-electrode fluorescent lamps, current balancing often is needed in order to provide uniform brightness over a LCD panel. But the current balancing can be difficult to achieve. For example, the negative operating impedance and positive current-temperature characteristics of a lamp can accelerate current imbalance and eventually drive the multi-lamp backlight module into a runaway situation. The multi-lamp backlight module includes a plurality of lamps parallel to the same driving source. In another example, unmatched parasitic parameters of the lamps, especially the parasitic capacitance, can exacerbate the current imbalance. In yet another example, cross-coupling between lamps may also contribute to the current imbalance.

As discussed above, there are conventional techniques for balancing lamp currents, but these conventional techniques have various weaknesses. For example, some conventional techniques can work for only two lamps driven by the same power transformer. In another example, certain conventional technique use a pyramid topology for stacking common-mode chokes as the number of lamps increases. The pyramid structure can make the multi-lamp driver system unstable and can complicate the layout of printed circuit board (PCB).

In yet another example, certain conventional techniques use an increasing number of inductors as the number of lamps increases. These inductors are parts of the balance chokes, and are in series with each other. To achieve current balance, the inductance of each balance choke should equal to its mutual inductance because the voltage across the series of the inductors needs to equal zero. These constraints on the balance chokes may limit applications of the corresponding conventional techniques.

Figure 1:
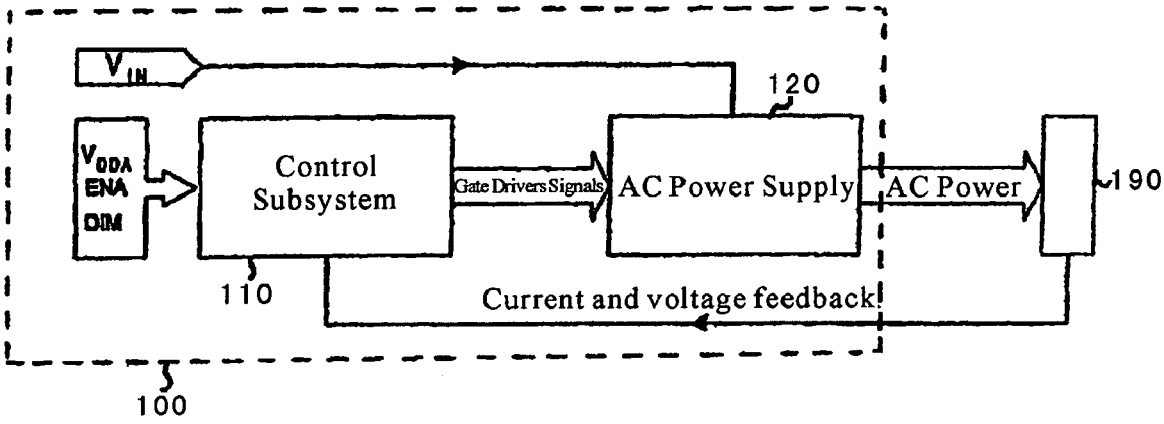
FIG. 1 is a simplified conventional driver system for CCFL and/or EEFL.
Figure 2:
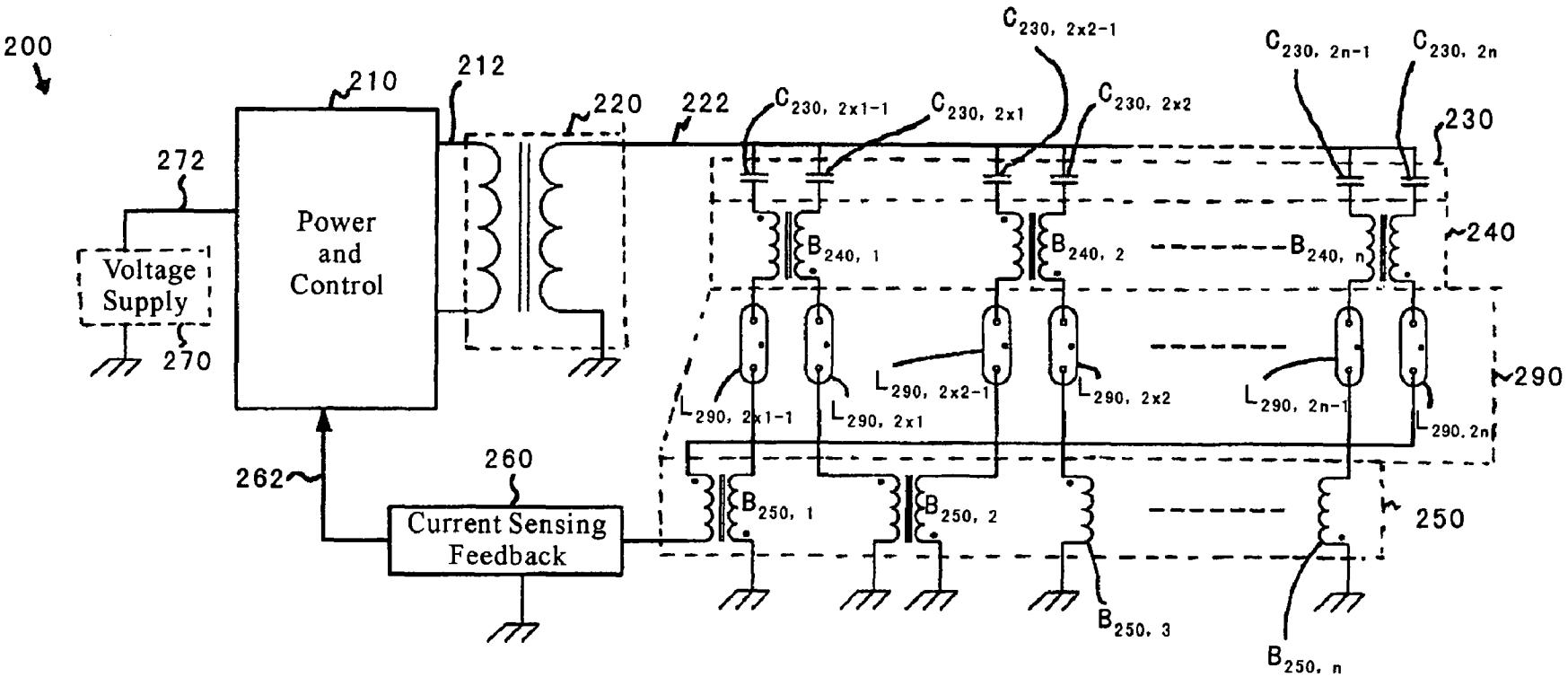
FIG. 2 is a simplified driver system according to an embodiment of the present invention.

FIG. 2 is a simplified driver system according to an embodiment of the present invention. This diagram is merely an example, which should not unduly limit the scope of the claims. One of ordinary skill in the art would recognize many variations, alternatives, and modifications. The driver system 200 includes a power and control subsystem 210, a power converter 220, the plurality of capacitors 230, one or more current balance chokes 240, one or more current balance chokes 250, a current sensing feedback component 260, and a voltage supply 270. Although the above has been shown using a selected group of components for the system 200, there can be many alternatives, modifications, and variations. For example, some of the components may be expanded and/or combined. Other components may be inserted to those noted above. Depending upon the embodiment, the arrangement of components may be interchanged with others replaced. For example, the system 200 is used to regulate a plurality of cold-cathode fluorescent lamps and/or external-electrode fluorescent lamps, such as a plurality of lamps 290. Further details of these components are found throughout the present specification and more particularly below.

The power and control subsystem 210 receives a voltage 272 from the voltage supply 270. For example, the voltage 272 is a DC voltage. In another example, the voltage 272 is equal to 5 volts. In response, the power and control subsystem 210 generates and provides an AC voltage 212 to the power converter 220.

According to an embodiment, the power and control subsystem 210 also receives certain control signals. For example, the control signals include an enabling (ENA) signal and a dimming (DIM) signal. In response, the power and control subsystem 210 generates one or more gate drive signals. Additionally, the power and control subsystem 210 includes one or more MOSFET transistors. These MOSFET transistors convert the voltage 272 to the AC voltage 212 in response to the one or more gate drive signals. According to another embodiment, the voltage supply 270 can use various types of configurations, such as Royer, push-pull, half-bridge, and/or full bridge.

The power converter 220 receives the AC voltage 212 and outputs an AC voltage 222 to the plurality of capacitors 230. According to one embodiment, the power converter 220 is a transformer. For example, the transformer includes a primary winding and a secondary winding. The primary winding receives the AC voltage 212 from the power and control subsystem 210, and the secondary winding outputs the AC voltage 222 to the one or more capacitors 230. For example, the secondary winding of the transformer has a much larger number of turns than the primary winding. According to another embodiment, the peak-to-peak amplitude of the AC voltage 222 is larger than the peak-to-peak amplitude of the AC voltage 212.

The plurality of capacitors 230 includes capacitors $C_{230,\ 2\times1-1}$, $C_{230,\ 2\times1}$, . . . , $C_{230,\ 2\times m-1}$, $C_{230,\ 2\times m}$, . . . , $C_{230,\ 2\times n-1}$, $C_{230,\ 2\times n}$. n is an integer equal to or larger than 1, and m is an integer equal to or larger than 1, and is equal to or smaller than n. In one embodiment, each capacitor includes two capacitor plates. One of these two capacitor plates receives the AC voltage 222, and the other of these two capacitor plates is coupled to the one or more current balance chokes 240.

The one or more current balance chokes 240 include current balance chokes $B_{240,\ 1}$, $B_{240,\ 2}$, . . . , $B_{240,\ m}$, . . . , $B_{240,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one of these two windings is coupled to a capacitor plate of a capacitor, and the other of these two windings is coupled to a capacitor plate of another capacitor. For example, the current balance choke $B_{240,\ m}$ is coupled to capacitors $C_{230,\ 2\times m-1}$ and $C_{230,\ 2\times m}$.

The one or more current balance chokes 250 include current balance chokes $B_{250,\ 1}$, $B_{250,\ 2}$, . . . , $B_{250,\ m}$, . . . , $B_{250,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one winding for the current balance choke $B_{250,\ 1}$ is coupled to the current sensing feedback component 260, and the other winding for the current balance choke $B_{250,\ 1}$ is coupled to a predetermined voltage level, such as the ground voltage. According to another embodiment, both windings for the current balance choke $B_{250,\ m}$ other than $B_{250,\ 1}$ are coupled to a predetermined voltage level, such as the ground voltage.

The current sensing feedback component 260 provides a current sensing signal 262 to the power and control subsystem 210. For example, the power and control subsystem 210 uses the current sensing signal 262 to regulate the current flowing into and/or out of each of the plurality of lamps 290. In another example, the power and control subsystem 210 includes a PWM controller whose output pulse width is adjusted in accordance with the current sensing signal 262.

As discussed above, the system 200 is used to regulate the plurality of lamps 290 according to an embodiment of the present invention. For example, the plurality of lamps 290 includes one or more cold-cathode fluorescent lamps, and/or one or more external-electrode fluorescent lamps. In another example, the plurality of lamps 290 includes lamps $L_{290,\ 2\times1-1}$, $L_{290,\ 2\times1}$, . . . , $L_{290,\ 2\times m-1}$, $L_{290,\ 2\times m}$, . . . , $L_{290,\ 2\times n-1}$, $L_{290,\ 2\times n}$. n is an integer equal to or larger than 1, and m is an integer equal to or larger than 1, and is equal to or smaller than n.

In one embodiment, each lamp includes two terminals. For example, one of the two terminals, e.g., a high-voltage terminal, is coupled to one winding of one of the one or more current balance chokes 240, and the other of the two terminals, e.g., a low-voltage terminal, is coupled to one winding of one of the one or more current balance chokes 250. In one embodiment, one winding of the current balance choke $B_{240,\ m}$ is coupled to one terminal of Lamp $L_{290,\ 2\times m-1}$, and the other winding of the current balance choke $B_{240,\ m}$ is coupled to one terminal of Lamp $L_{290,\ 2\times m}$. In another embodiment, if m is larger than 1, one winding of the current balance choke $B_{250,\ m}$ is coupled to one terminal of Lamp $L_{290,\ 2\times(m-1)}$, and the other winding of the current balance choke $B_{250,\ m}$ is coupled to one terminal of Lamp $L_{290,\ 2\times m-1}$. In yet another embodiment, one winding of the current balance choke $B_{250,\ 1}$ is coupled to one terminal of Lamp $L_{290,\ 2\times n}$, and the other winding of the current balance choke $B_{250,\ 1}$ is coupled to one terminal of Lamp $L_{290,\ 2\times1-1}$.

In another embodiment, the connections between the plurality of lamps 290 and the current balance chokes 240 and 250 are arranged in a cyclic configuration. For example, the high-voltage terminal of Lamp $L_{290,\ 2\times m-1}$ and the high-voltage terminal for Lamp $L_{290,\ 2\times m}$ are connected to the same current balance choke $B_{240,\ m}$. The current balance choke $B_{240,\ m}$ can make the currents flowing into the high voltage terminals of the Lamps $L_{290,\ 2\times m-1}$ and $L_{290,\ 2\times m}$ to be the same. In another example, if m is larger than 1, the low-voltage terminal of Lamp $L_{290,\ 2\times(m-1)}$ and the low-voltage terminal of Lamp $L_{290,\ 2\times m-1}$ are connected to the same current balance choke $B_{250,\ m}$. The current balance choke $B_{250,\ m}$ can make the currents flowing out of the low voltage terminals of the Lamps $L_{290,\ 2\times(m-1)}$ and $L_{290,\ 2\times m-1}$ to be the same. In yet another example, the low-voltage terminal of Lamp $L_{290,\ 2\times n}$, and the low-voltage terminal of Lamp $L_{290,\ 2\times1-1}$ are coupled to the same current balance choke $B_{250,\ 1}$. The current balance choke $B_{250,\ 1}$ can make the currents flowing out of the low voltage terminals of the Lamps $L_{290,\ 2\times n}$ and $L_{290,\ 2\times1-1}$ to be the same. In yet another embodiment, the system 200 can make currents flowing through the plurality of lamps 290 the same if a current flowing into a high-terminal of a lamp is substantially the same as another current flowing out of a low-voltage terminal of the same lamp.

As discussed above and further emphasized here, FIG. 2 is merely an example, which should not unduly limit the scope of the claims. One of ordinary skill in the art would recognize many variations, alternatives, and modifications. In one embodiment, the power and control subsystem 210 receives a voltage sensing signal, in addition to or instead of the current sensing signal 262. In another embodiment, the current sensing signal 262 represents the current from any single lamp selected from the plurality of lamps 290. In yet another embodiment, the current sensing signal 262 represents the total current of some or all of the plurality of lamps 290, and the total current can be regulated by the power and control subsystem 210.

According to another embodiment, the system 200 is used to regulate a plurality of lamps 290 including an odd number of lamps. For example, the plurality of lamps 290 includes lamps $L_{290,\ 2\times1-1}$, $L_{290,\ 2\times1}$, . . . , $L_{290,\ 2\times m-1}$, $L_{290,\ 2\times m}$, . . . , and $L_{290,\ 2\times n-1}$. Additionally, the plurality of capacitors 230 includes capacitors $C_{230,\ 2\times1-1}$, $C_{230,\ 2\times1}$, . . . , $C_{230,\ 2\times m-1}$, $C_{230,\ 2\times m}$, $C_{230,\ 2\times n-1}$. Moreover, the one or more current balance chokes 240 include current balance chokes $B_{240,\ 1}$, $B_{240,\ 2}$, . . . , $B_{240,\ m}$, . . . , $B_{240,\ n-1}$. Also, the one or more current balance chokes 250 include current balance chokes $B_{250,\ 1}$, $B_{250,\ 2}$, . . . , $B_{250,\ m}$, . . . , $B_{250,\ n}$. n is an integer larger than 1, and m is an integer equal to or larger than 1, and is equal to or smaller than n. In one embodiment, the high-voltage terminal of Lamp $L_{290,\ 2\times n-1}$ is coupled to a capacitor plate of the capacitor $C_{230,\ 2\times n-1}$. In another embodiment, the low-voltage terminal of Lamp $L_{290,\ 2\times n-1}$, and the low-voltage terminal of Lamp $L_{290,\ 2\times 1-1}$ are coupled to the same current balance choke $B_{250,\ 1}$. The current balance choke $B_{250,\ 1}$ can make the currents flowing out of the low voltage terminals of the Lamps $L_{290,\ 2\times n-1}$ and $L_{290,\ 2\times 1-1}$ to be the same. In yet another embodiment, the current balance choke $B_{250,\ 1}$ and the low-voltage terminal of Lamp $L_{290,\ 2\times(n-1)}$ are coupled to the current balance choke $B_{250,\ n}$. The current balance choke $B_{250,\ 1}$ can make the currents flowing out of the low voltage terminals of the Lamps $L_{290,\ 2\times n-1}$ and $L_{290,\ 2\times 1-1}$ to be the same. For example, the current from Lamp $L_{290,\ 2\times n-1}$ flows through one winding of the current balance choke $B_{250,\ 1}$ and then flow through one winding of the current balance choke $B_{250,\ n}$. Accordingly, the current balance choke $B_{250,\ n}$ can make the currents flowing out of the low voltage terminals of the Lamps $L_{290,\ 2\times(n-1)}$ and $L_{290,\ 2\times n-1}$ to be the same.

Figure 3:
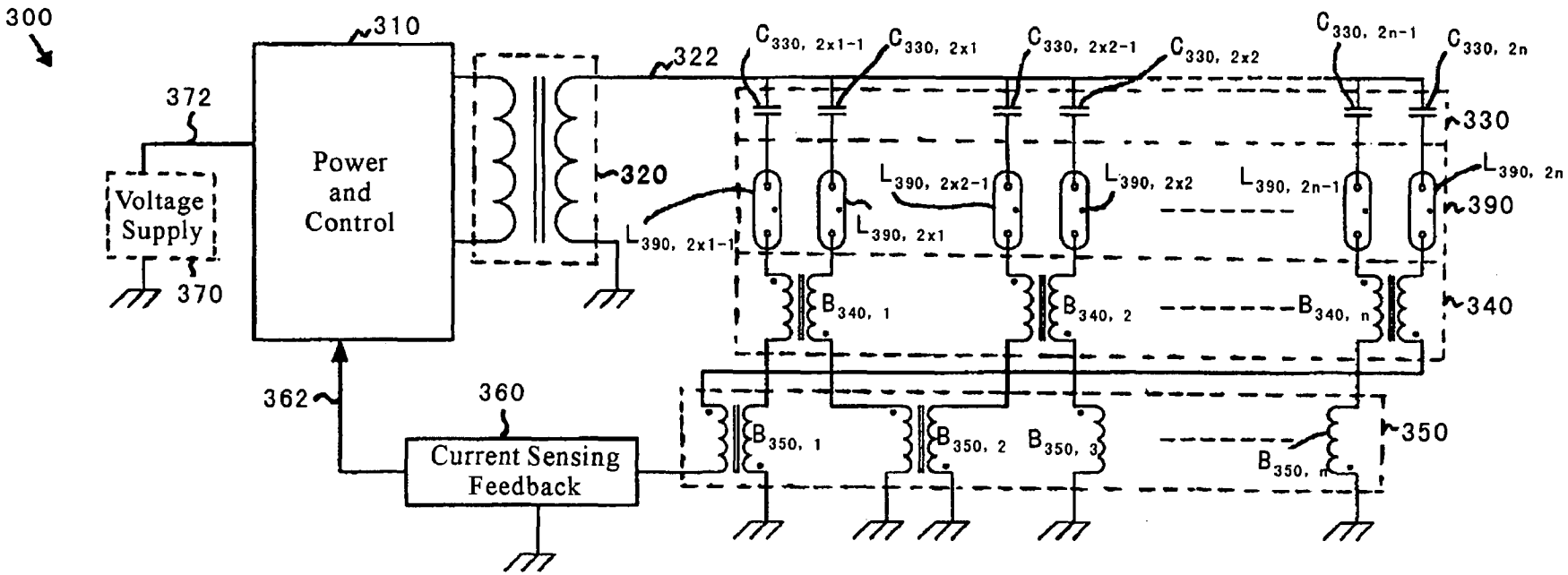
FIG. 3 is a simplified driver system according to another embodiment of the present invention.

FIG. 3 is a simplified driver system according to another embodiment of the present invention. This diagram is merely an example, which should not unduly limit the scope of the claims. One of ordinary skill in the art would recognize many variations, alternatives, and modifications. The driver system 300 includes a power and control subsystem 310, a power converter 320, the plurality of capacitors 330, one or more current balance chokes 340, one or more current balance chokes 350, a current sensing feedback component 360, and a voltage supply 370. Although the above has been shown using a selected group of components for the system 300, there can be many alternatives, modifications, and variations. For example, some of the components may be expanded and/or combined. Other components may be inserted to those noted above. Depending upon the embodiment, the arrangement of components may be interchanged with others replaced. For example, the system 300 is used to regulate a plurality of cold-cathode fluorescent lamps and/or external-electrode fluorescent lamps, such as a plurality of lamps 390. Further details of these components are found throughout the present specification and more particularly below.

The power and control subsystem 310 receives a voltage 372 from the voltage supply 370. For example, the voltage 372 is a DC voltage. In another example, the voltage 372 is equal to 5 volts. In response, the power and control subsystem 310 generates and provides an AC voltage 312 to the power converter 320.

According to an embodiment, the power and control subsystem 310 also receives certain control signals. For example, the control signals include an enabling (ENA) signal and a dimming (DIM) signal. In response, the power and control subsystem 310 generates one or more gate drive signals. Additionally, the power and control subsystem 310 includes one or more MOSFET transistors. These MOSFET transistors convert the voltage 372 to the AC voltage 312 in response to the one or more gate drive signals. According to another embodiment, the voltage supply 370 can use various types of configurations, such as Royer, push-pull, half-bridge, and/or full bridge.

The power converter 320 receives the AC voltage 312 and outputs an AC voltage 322 to the plurality of capacitors 330. According to one embodiment, the power converter 320 is a transformer. For example, the transformer includes a primary winding and a secondary winding. The primary winding receives the AC voltage 312 from the power and control subsystem 310, and the secondary winding outputs the AC voltage 322 to the one or more capacitors 330. For example, the secondary winding of the transformer has a much larger number of turns than the primary winding. According to another embodiment, the peak-to-peak amplitude of the AC voltage 322 is larger than the peak-to-peak amplitude of the AC voltage 312.

The plurality of capacitors 330 includes capacitors $C_{330,\ 2\times 1-1}$, $C_{330,\ 2\times 1}$, . . . , $C_{330,\ 2\times m-1}$, $C_{330,\ 2\times m}$, . . . , $C_{330,\ 2\times n-1}$, $C_{330,\ 2\times n}$. n is an integer equal to or larger than 1, and m is an integer equal to or larger than 1, and is equal to or smaller than n. In one embodiment, each capacitor includes two capacitor plates. One of these two capacitor plates receives the AC voltage 322.

The one or more current balance chokes 340 include current balance chokes $B_{340,\ 1}$, $B_{340,\ 2}$, . . . , $B_{340,\ m}$, . . . , $B_{340,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core.

The one or more current balance chokes 350 include current balance chokes $B_{350,\ 1}$, $B_{350,\ 2}$, . . . , $B_{350,\ m}$, . . . , $B_{350,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one winding for the current balance choke $B_{350,\ 1}$ is coupled to the current sensing feedback component 360, and the other winding for the current balance choke $B_{350,\ 1}$ is coupled to a predetermined voltage level, such as the ground voltage. According to another embodiment, both windings for the current balance choke $B_{250,\ m}$ other than $B_{250,\ 1}$ are coupled to a predetermined voltage level, such as the ground voltage.

According to an embodiment, if m is larger than 1, one winding of the current balance choke $B_{350,\ m}$ is coupled to one winding of the current balance choke $B_{340,\ m-1}$, and the other winding of the current balance choke $B_{350,\ m}$ is coupled to one winding of the current balance choke $B_{340,\ m}$. According to another embodiment, one winding of the current balance choke $B_{350,\ 1}$ is coupled to one winding of the current balance choke $B_{340,\ n}$, and the other winding of the current balance choke $B_{350,\ 1}$ is coupled to one winding of the current balance choke $B_{340,\ 1}$.

The current sensing feedback component 360 provides a current sensing signal 362 to the power and control subsystem 310. For example, the power and control subsystem 310 uses the current sensing signal 362 to regulate the current flowing into and/or out of each of the plurality of lamps 390. In another example, the power and control subsystem 310 includes a PWM controller whose output pulse width is adjusted in accordance with the current sensing signal 362.

As discussed above, the system 300 is used to regulate the plurality of lamps 390 according to an embodiment of the present invention. For example, the plurality of lamps 390 includes one or more cold-cathode fluorescent lamps, and/or one or more external-electrode fluorescent lamps. In another example, the plurality of lamps 390 includes lamps $L_{390,\ 2\times 1-1}$, $L_{390,\ 2\times 1}$, . . . , $L_{390,\ 2\times m-1}$, $L_{390,\ 2\times m}$, . . . , $L_{390,\ 2\times n-1}$, $L_{390,\ 2\times n}$. n is an integer equal to or larger than 1, and m is an integer equal to or larger than 1, and is equal to or smaller than n.

In one embodiment, each lamp includes two terminals. For example, one of the two terminals, e.g., a high-voltage terminal, is coupled to one capacitor plate of one of the plurality of capacitors 330, and the other of the two terminals, e.g., a low-voltage terminal, is coupled to one winding of one of the one or more current balance chokes 340. In another example, the high-voltage terminal of Lamp $L_{390,\ 2\times m-1}$ is coupled to the capacitor $C_{330,\ 2\times m-1}$, and the high-voltage terminal of Lamp $L_{390,\ 2\times m}$ is coupled to the capacitor $C_{330,\ 2\times m}$. Additionally, the low-voltage terminals of Lamps $L_{390,\ 2\times m-1}$ and $L_{390,\ 2\times m}$ are coupled to the current balance choke $B_{340,\ m}$.

In another embodiment, the connections among the plurality of lamps 390, the current balance chokes 340, and the current balance chokes 350 are arranged in a cyclic configuration. For example, the current from low-voltage terminal of Lamp $L_{390,\ 2\times m-1}$ flows through one winding of the current balance choke $B_{340,\ m}$, and one winding of the current balance choke $B_{350,\ m}$. In another example, if m is smaller than n, the current from low-voltage terminal of Lamp $L_{390,\ 2\times m}$ flows through one winding of the current balance choke $B_{340,\ m}$, and one winding of the current balance choke $B_{350,\ m+1}$. In yet another example, if m is equal to n, the current from low-voltage terminal of Lamp $L_{390,\ 2\times n}$ flows through one winding of the current balance choke $B_{340,\ m}$, and one winding of the current balance choke $B_{350,\ 1}$. In yet another embodiment, the system 300 can make currents flowing from the plurality of lamps 390 the same as shown in FIG. 3.

As discussed above and further emphasized here, FIG. 3 is merely an example, which should not unduly limit the scope of the claims. One of ordinary skill in the art would recognize many variations, alternatives, and modifications. In one embodiment, the power and control subsystem 310 receives a voltage sensing signal, in addition to or instead of the current sensing signal 362. In another embodiment, the current sensing signal 362 represents the current from any single lamp selected from the plurality of lamps 390. In yet another embodiment, the current sensing signal 362 represents the total current of some or all of the plurality of lamps 390, and the total current can be regulated by the power and control subsystem 310.

According to another embodiment, the system 300 is used to regulate a plurality of lamps 390 including an odd number of lamps. For example, the plurality of lamps 390 includes lamps $L_{390,\ 2\times1-1}$, $L_{390,\ 2\times1}$, . . . , $L_{390,\ 2\times m-1}$, $L_{390,\ 2\times m}$, . . . , and $L_{390,\ 2\times n-1}$. Additionally, the plurality of capacitors 330 includes capacitors $C_{330,\ 2\times1-1}$, $C_{330,\ 2\times1}$, . . . , $C_{330,\ 2\times m-1}$, $C_{330,\ 2\times m}$, . . . , $C_{330,\ 2\times n-1}$. Moreover, the one or more current balance chokes 340 include current balance chokes $B_{340,\ 1}$, $B_{340,\ 2}$, . . . , $B_{340,\ m}$, . . . , $B_{340,\ n-1}$. Also, the one or more current balance chokes 350 include current balance chokes $B_{350,\ 1}$, $B_{350,\ 2}$, . . . , $B_{350,\ m}$, . . . , $B_{350,\ n}$. n is an integer larger than 1, and m is an integer equal to or larger than 1, and is equal to or smaller than n. For example, if m is smaller than n, the current from low-voltage terminal of Lamp $L_{390,\ 2\times m-1}$ flows through one winding of the current balance choke $B_{340,\ m}$, and one winding of the current balance choke $B_{350,\ m}$. Additionally, the current from the low-voltage terminal of Lamp $L_{390,\ 2\times n-1}$ flows through one winding of the current balance choke $B_{350,\ 1}$, and the current from the low-voltage terminal of Lamp $L_{390,\ 1}$ flows through one winding of the current balance choke $B_{340,\ 1}$ and one winding of the current balance choke $B_{350,\ 1}$. Accordingly, the current balance choke $B_{350,\ 1}$ can make currents from the low-voltage terminal of Lamp $L_{390,\ 2\times n-1}$ and the low-voltage terminal of Lamp $L_{390,\ 1}$ the same.

In another example, the current from the low-voltage terminal of Lamp $L_{390,\ 2\times(n-1)}$ flows through one winding of the current balance choke $B_{340,\ n-1}$ and one winding of the current balance choke $B_{350,\ n}$. Additionally, the current balance choke $B_{350,\ 1}$ and the current balance choke $B_{340,\ n-1}$ are coupled to the current balance choke $B_{350,\ n}$. Accordingly, the current balance choke $B_{350,\ n}$ can make the currents flowing out of the low voltage terminals of the Lamps $L_{390,\ 2\times(n-1)}$ and $L_{390,\ 2\times n-1}$ to be the same.

Figure 4:
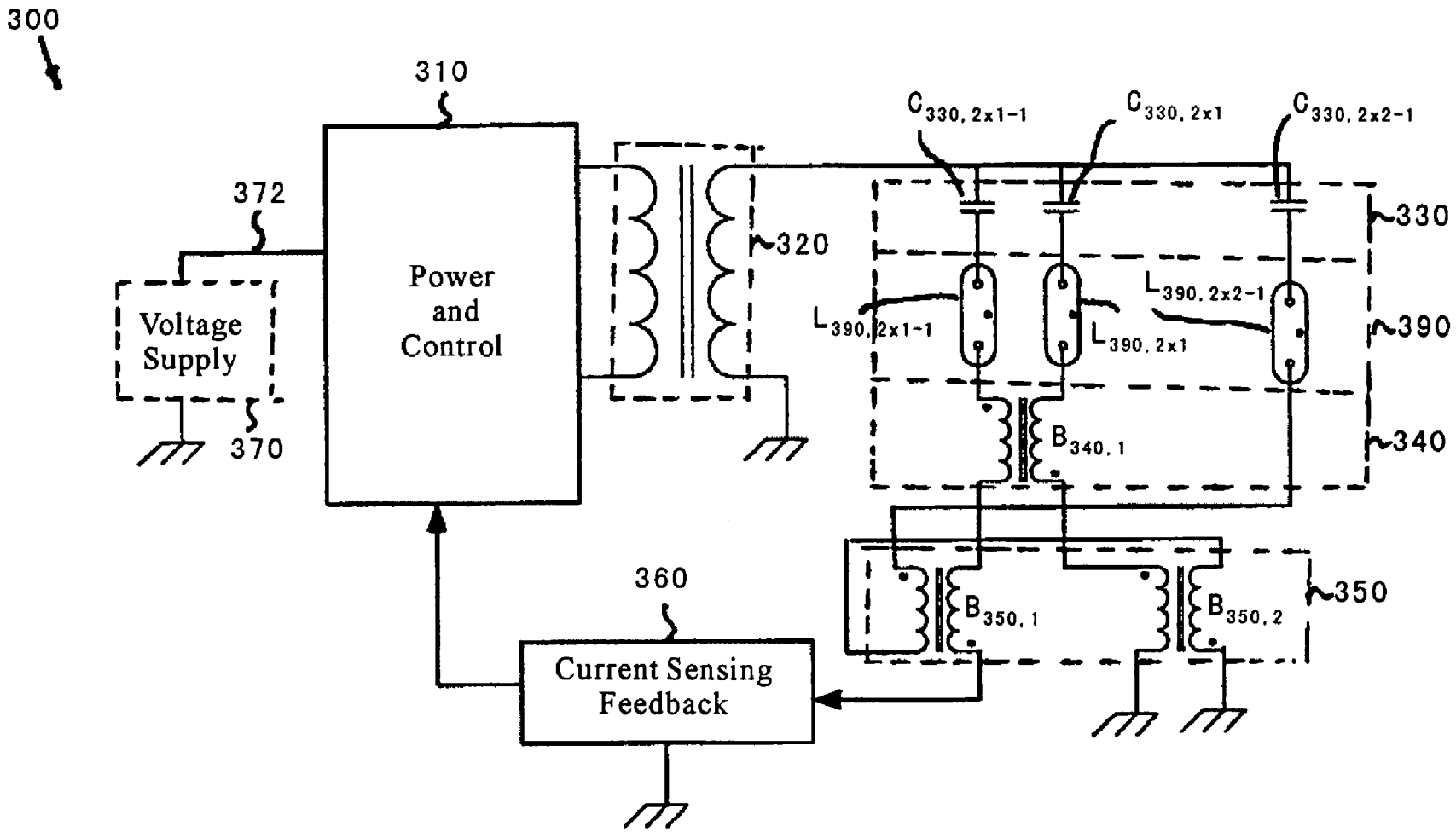
FIG. 4 is a simplified driver system according to yet another embodiment of the present invention.

FIG. 4 is a simplified driver system 300 according to yet another embodiment of the present invention. This diagram is merely an example, which should not unduly limit the scope of the claims. One of ordinary skill in the art would recognize many variations, alternatives, and modifications. As shown in FIG. 4, the driver system 300 is used to regulate a plurality of lamps 390 including three lamps. For example, the plurality of lamps 390 includes lamps $L_{390,\ 2\times1-1}$, $L_{390,\ 2\times1}$, and $L_{390,\ 2\times2-1}$. Additionally, the plurality of capacitors 330 includes capacitors $C_{330,\ 2\times1-1}$, $C_{330,\ 2\times1}$, and $C_{330,\ 2\times2-1}$. Moreover, the one or more current balance chokes 340 include the current balance choke $B_{340,\ 1}$. Also, the one or more current balance chokes 350 include current balance chokes $B_{350,\ 1}$ and $B_{350,\ 2}$. For example, the current from low-voltage terminal of Lamp $L_{390,\ 2\times1-1}$ flows through one winding of the current balance choke $B_{340,\ 1}$, and one winding of the current balance choke $B_{350,\ 1}$. Additionally, the current from the low-voltage terminal of Lamp $L_{390,\ 2\times2-1}$ flows through one winding of the current balance choke $B_{350,\ 1}$, and the current from the low-voltage terminal of Lamp $L_{390,\ 1}$ flows through one winding of the current balance choke $B_{340,\ 1}$ and one winding of the current balance choke $B_{350,\ 1}$. Accordingly, the current balance choke $B_{350,\ 1}$ can make currents from the low-voltage terminal of Lamp $L_{390,\ 2\times2-1}$ and the low-voltage terminal of Lamp $L_{390,\ 1}$ the same. In another example, the current from the low-voltage terminal of Lamp $L_{390,\ 2}$ flows through one winding of the current balance choke $B_{340,\ 1}$ and one winding of the current balance choke $B_{350,\ 2}$. Additionally, the current balance choke $B_{350,\ 1}$ and the current balance choke $B_{340,\ 1}$ are coupled to the current balance choke $B_{350,\ 2}$. Accordingly, the current balance choke $B_{350,\ 2}$ can make the currents flowing out of the low voltage terminals of the Lamps $L_{390,\ 2}$ and $L_{390,\ 3}$ to be the same.

Figure 5:
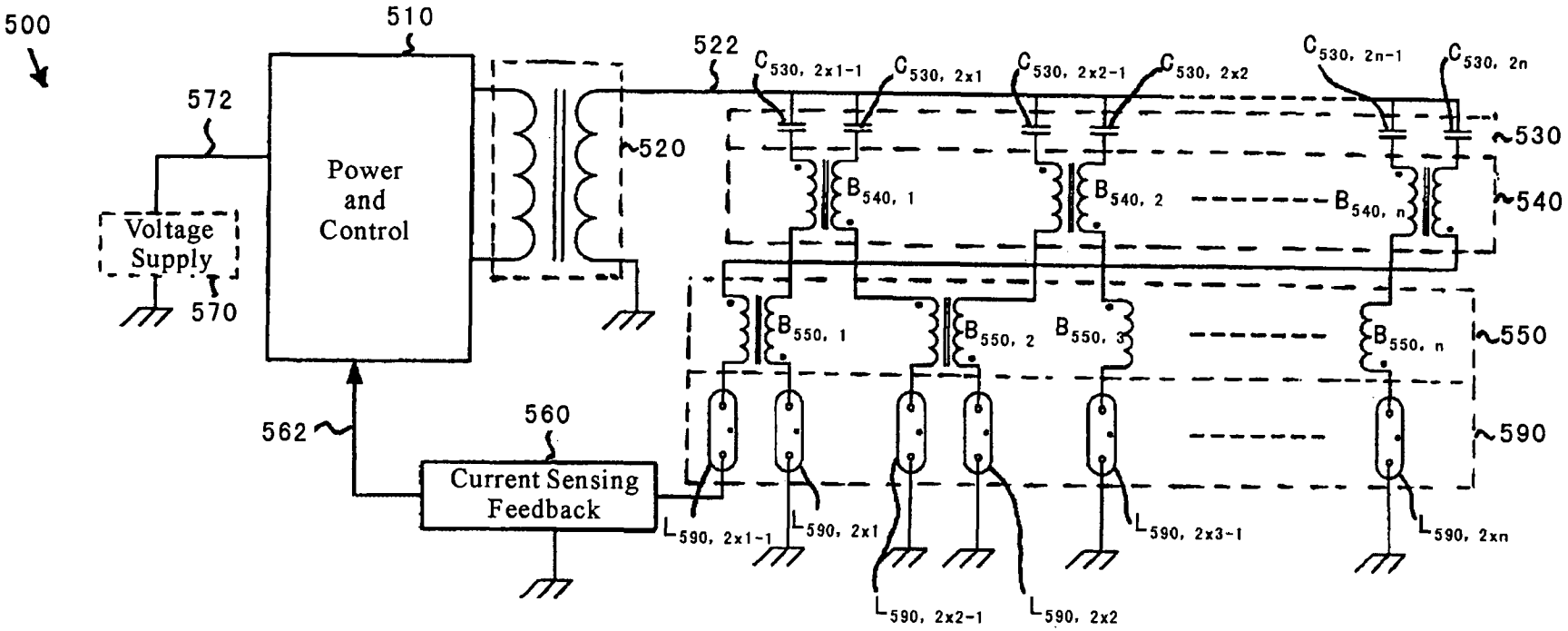
FIG. 5 is a simplified driver system according to yet another embodiment of the present invention.

FIG. 5 is a simplified driver system according to yet another embodiment of the present invention. This diagram is merely an example, which should not unduly limit the scope of the claims. One of ordinary skill in the art would recognize many variations, alternatives, and modifications. The driver system 500 includes a power and control subsystem 510, a power converter 520, the plurality of capacitors 530, one or more current balance chokes 540, one or more current balance chokes 550, a current sensing feedback component 560, and a voltage supply 570. Although the above has been shown using a selected group of components for the system 500, there can be many alternatives, modifications, and variations. For example, some of the components may be expanded and/or combined. Other components may be inserted to those noted above. Depending upon the embodiment, the arrangement of components may be interchanged with others replaced. For example, the system 500 is used to regulate a plurality of cold-cathode fluorescent lamps and/or external-electrode fluorescent lamps, such as a plurality of lamps 590. Further details of these components are found throughout the present specification and more particularly below.

The power and control subsystem 510 receives a voltage 572 from the voltage supply 570. For example, the voltage 572 is a DC voltage. In another example, the voltage 572 is equal to 5 volts. In response, the power and control subsystem 510 generates and provides an AC voltage 512 to the power converter 520.

According to an embodiment, the power and control subsystem 510 also receives certain control signals. For example, the control signals include an enabling (ENA) signal and a dimming (DIM) signal. In response, the power and control subsystem 510 generates one or more gate drive signals. Additionally, the power and control subsystem 510 includes one or more MOSFET transistors. These MOSFET transistors convert the voltage 572 to the AC voltage 512 in response to the one or more gate drive signals. According to another embodiment, the voltage supply 570 can use various types of configurations, such as Royer, push-pull, half-bridge, and/or full bridge.

The power converter 520 receives the AC voltage 512 and outputs an AC voltage 522 to the plurality of capacitors 530. According to one embodiment, the power converter 520 is a transformer. For example, the transformer includes a primary winding and a secondary winding. The primary winding receives the AC voltage 512 from the power and control subsystem 510, and the secondary winding outputs the AC voltage 522 to the one or more capacitors 530. For example, the secondary winding of the transformer has a much larger number of turns than the primary winding. According to another embodiment, the peak-to-peak amplitude of the AC voltage 522 is larger than the peak-to-peak amplitude of the AC voltage 512.

The plurality of capacitors 530 includes capacitors $C_{530,\ 2\times1-1}$, $C_{530,\ 2\times1}$, . . . , $C_{530,\ 2\times m-1}$, $C_{530,\ 2\times m}$, . . . , $C_{530,\ 2\times n-1}$, $C_{530,\ 2\times n}$. n is an integer equal to or larger than 1, and m is an integer equal to or larger than 1, and is equal to or smaller than n. In one embodiment, each capacitor includes two capacitor plates. One of these two capacitor plates receives the AC voltage 522, and the other of these two capacitor plates is coupled to the one or more current balance chokes 540.

The one or more current balance chokes 540 include current balance chokes $B_{540,\ 1}$, $B_{540,\ 2}$, . . . , $B_{540,\ m}$, . . . , $B_{540,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one of these two windings is coupled to a capacitor plate of a capacitor, and the other of these two windings is coupled to a capacitor plate of another capacitor. For example, the current balance choke $B_{540,\ m}$ is coupled to capacitors $C_{530,\ 2\times m-1}$ and $C_{530,\ 2\times m}$.

The one or more current balance chokes 550 include current balance chokes $B_{550,\ 1}$, $B_{550,\ 2}$, . . . , $B_{550,\ m}$, . . . , $B_{550,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core.

According to an embodiment, if m is larger than 1, one winding of the current balance choke $B_{550,\ m}$ is coupled to one winding of the current balance choke $B_{540,\ m-1}$, and the other winding of the current balance choke $B_{550,\ m}$ is coupled to one winding of the current balance choke $B_{540,\ m}$. According to another embodiment, one winding of the current balance choke $B_{550,\ 1}$ is coupled to one winding of the current balance choke $B_{540,\ n}$, and the other winding of the current balance choke $B_{550,\ 1}$ is coupled to one winding of the current balance choke $B_{540,\ 1}$.

The current sensing feedback component 560 provides a current sensing signal 562 to the power and control subsystem 510. For example, the power and control subsystem 510 uses the current sensing signal 562 to regulate the current flowing into and/or out of each of the plurality of lamps 590. In another example, the power and control subsystem 510 includes a PWM controller whose output pulse width is adjusted in accordance with the current sensing signal 562.

As discussed above, the system 500 is used to regulate the plurality of lamps 590 according to an embodiment of the present invention. For example, the plurality of lamps 590 includes one or more cold-cathode fluorescent lamps, and/or one or more external-electrode fluorescent lamps. In another example, the plurality of lamps 590 includes lamps $L_{590,\ 2\times1-1}$, $L_{590,\ 2\times1}$, . . . , $L_{590,\ 2\times m-1}$, $L_{590,\ 2\times m}$, . . . , $L_{590,\ 2\times n-1}$, $L_{590,\ 2\times n}$. n is an integer equal to or larger than 1, and m is an integer equal to or larger than 1, and is equal to or smaller than n.

In one embodiment, each lamp includes two terminals. For example, one of the two terminals, e.g., a high-voltage terminal, is coupled to one winding of the one or more current balance chokes 550. In another example, the low-voltage terminal of Lamp $L_{590,\ 2\times m}$ is coupled to coupled to a predetermined voltage level, such as the ground voltage. In yet another example, if m is larger than 1, the low-voltage terminal of Lamp $L_{590,\ 2\times m-1}$ is coupled to a predetermined voltage level, such as the ground voltage. In yet another example, the low-voltage terminal of Lamp $L_{390,\ 2\times1-1}$ is coupled to the current sensing feedback component 560.

In another embodiment, the connections among the plurality of lamps 590, the current balance chokes 540, and the current balance chokes 550 are arranged in a cyclic configuration. For example, the current flowing into high-voltage terminal of Lamp $L_{590,\ 2\times m}$ flows through one winding of the current balance choke $B_{540,\ m}$, and one winding of the current balance choke $B_{550,\ m}$. In another example, if m is larger than 1, the current flowing into high-voltage terminal of Lamp $L_{590,\ 2\times m-1}$ flows through one winding of the current balance choke $B_{540,\ m-1}$, and one winding of the current balance choke $B_{550,\ m}$. In yet another example, if m is equal to 1, the current flowing into high-voltage terminal of Lamp $L_{390,\ 2\times1-1}$ flows through one winding of the current balance choke $B_{540,\ 1}$, and one winding of the current balance choke $B_{550,\ m}$. In yet another embodiment, the system 500 can make currents flowing into the plurality of lamps 590 the same as shown in FIG. 5.

As discussed above and further emphasized here, FIG. 5 is merely an example, which should not unduly limit the scope of the claims. One of ordinary skill in the art would recognize many variations, alternatives, and modifications. In one embodiment, the power and control subsystem 510 receives a voltage sensing signal, in addition to or instead of the current sensing signal 562. In another embodiment, the current sensing signal 562 represents the current from any single lamp selected from the plurality of lamps 590. In yet another embodiment, the current sensing signal 562 represents the total current of some or all of the plurality of lamps 590, and the total current can be regulated by the power and control subsystem 510.

According to another embodiment, the system 300 is used to regulate the plurality of lamps 590 including an odd number of lamps. For example, the plurality of lamps 590 includes lamps $L_{590,\ 2\times1-1}$, $L_{590,\ 2\times1}$, . . . , $L_{590,\ 2\times m-1}$, $L_{590,\ 2\times m}$, . . . , and $L_{590,\ 2\times n-1}$. n is an integer larger than 1, and m is an integer equal to or larger than 1, and is equal to or smaller than n.

FIGS. 2, 3, 4, and 5 are merely examples, which should not unduly limit the scope of the claims. One of ordinary skill in the art would recognize many variations, alternatives, and modifications. For example, the plurality of capacitors 230, 330, or 530 are coupled to a plurality of transformers. In another example, the plurality of transformers are used to regulate the plurality of cold-cathode fluorescent lamps and/or external-electrode fluorescent lamps, such as a plurality of lamps 290, 390, or 590.

Figure 6:
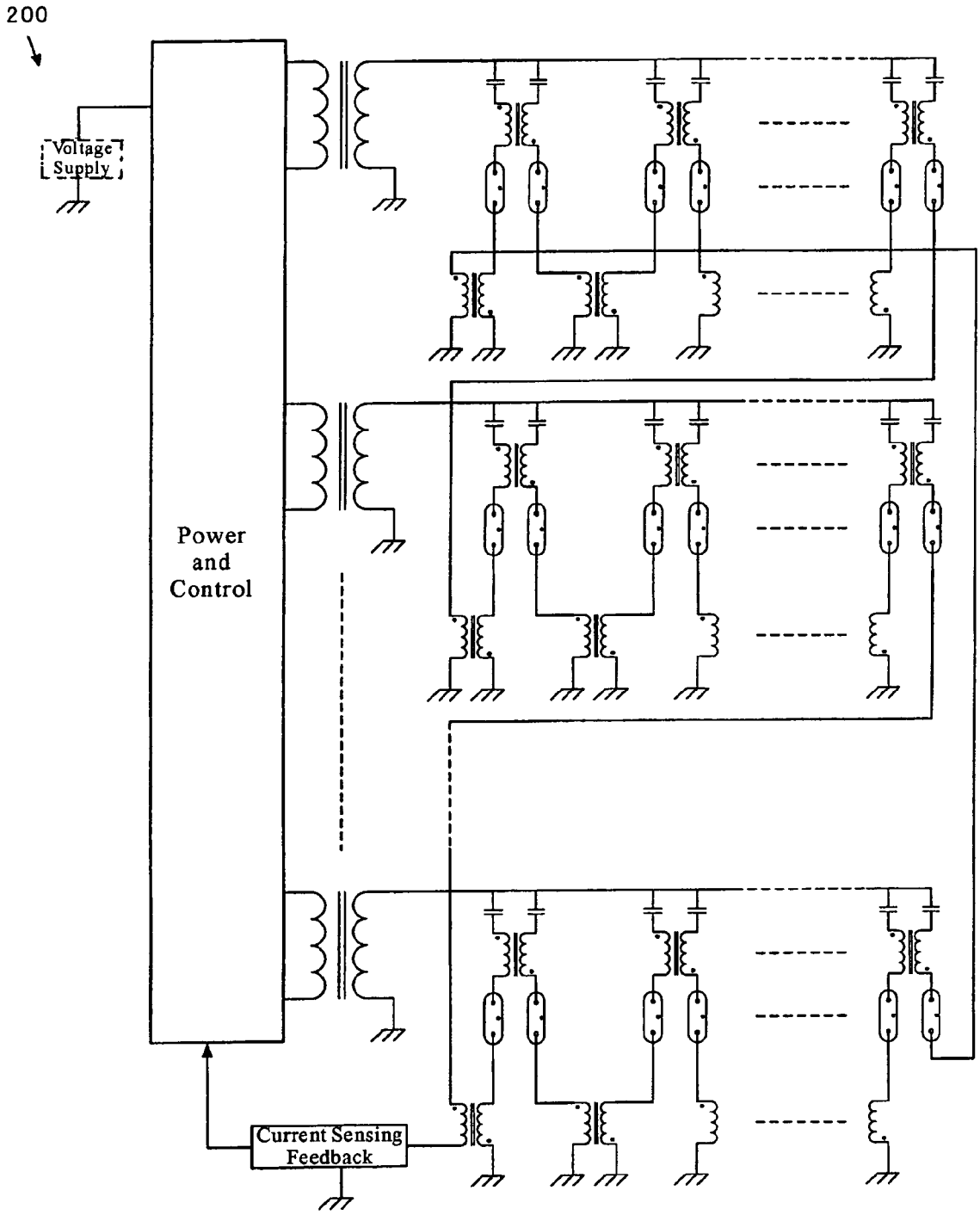
FIG. 6 is a simplified driver system according to yet another embodiment of the present invention.

FIG. 6 is a simplified driver system 200 according to yet another embodiment of the present invention. This diagram is merely an example, which should not unduly limit the scope of the claims. One of ordinary skill in the art would recognize many variations, alternatives, and modifications. The driver system 200 includes a power and control subsystem, a power converter, the plurality of capacitors, one or more current balance chokes, one or more current balance chokes, a current sensing feedback component, and a voltage supply. For example, the power converter includes a plurality of transformers, whose primary windings are coupled to the power and control subsystem and whose secondary windings are coupled to different capacitors selected from the plurality of capacitors.

Figure 7:
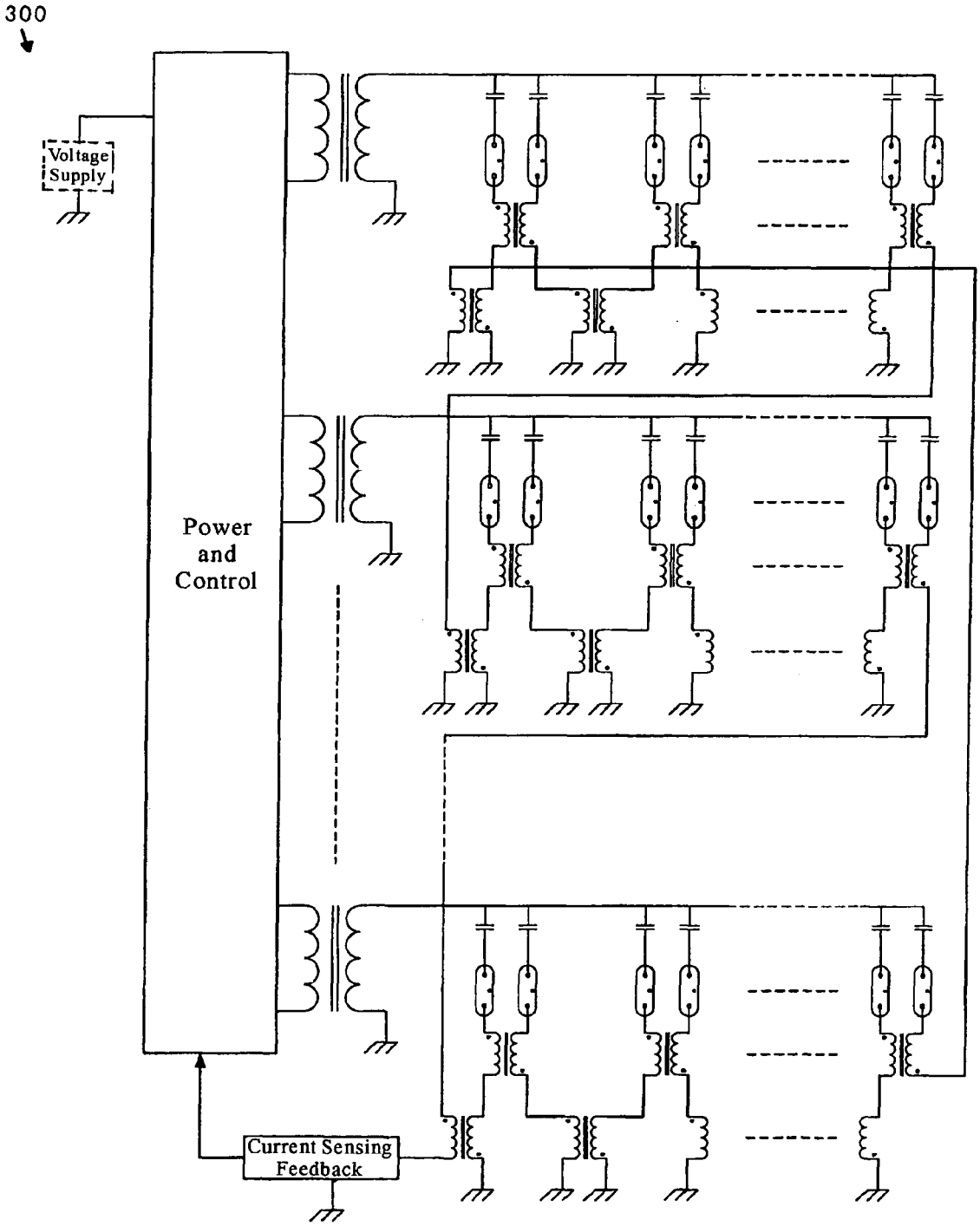
FIG. 7 is a simplified driver system 300 according to yet another embodiment of the present invention.

FIG. 7 is a simplified driver system 300 according to yet another embodiment of the present invention. This diagram is merely an example, which should not unduly limit the scope of the claims. One of ordinary skill in the art would recognize many variations, alternatives, and modifications. The driver system 300 includes a power and control subsystem, a power converter, the plurality of capacitors, one or more current balance chokes, one or more current balance chokes, a current sensing feedback component, and a voltage supply. For example, the power converter includes a plurality of transformers, whose primary windings are coupled to the power and control subsystem and whose secondary windings are coupled to different capacitors selected from the plurality of capacitors.

According to another embodiment of the present invention, a system for driving a plurality of cold-cathode fluorescent lamps includes a subsystem configured to receive at least a DC voltage and generate a first AC voltage in response to at least the DC voltage, a power converter configured to receive the first AC voltage and convert the first AC voltage to at least a second AC voltage, and a plurality of current balancing devices. Each of the plurality of current balancing devices is configured to receive two currents and balance the two currents. The power converter and the plurality of current balancing devices are capable of being directly or indirectly coupled to a plurality of cold-cathode fluorescent lamps. For each of the plurality of cold-cathode fluorescent lamps, each of the plurality of cold-cathode fluorescent lamps is associated with a lamp current, and the plurality of cold-cathode fluorescent lamps includes at least a first lamp and a second lamp. Both the first lamp and the second lamp are different from the each of the plurality of cold-cathode fluorescent lamps. The first lamp and the second lamp are associated with a first current and a second current respectively. Additionally, a first current balancing device selected from the plurality of current balancing devices is configured to receive the lamp current and the first current and to balance the lamp current and the first current, and a second current balancing device selected from the plurality of current balancing devices is configured to receive the lamp current and the second current and to balance the lamp current and the first current. For example, the system is implemented according to FIG. 3, FIG. 5, and/or FIG. 7.

According to yet another embodiment of the present invention, a system for driving a plurality of cold-cathode fluorescent lamps includes a subsystem configured to receive at least a DC voltage and generate a first AC voltage in response to at least the DC voltage, a power converter configured to receive the first AC voltage and convert the first AC voltage to at least a second AC voltage, and a plurality of current balancing devices. Each of the plurality of current balancing devices is configured to receive two currents and balance the two currents. The power converter and the plurality of current balancing devices are capable of being directly or indirectly coupled to a first plurality of cold-cathode fluorescent lamps. The first plurality of cold-cathode fluorescent lamps includes a second plurality of cold-cathode fluorescent lamps and a third lamp, and the third cold-cathode fluorescent lamp is associated with a first current. For each of the second plurality of cold-cathode fluorescent lamps, each of the second plurality of cold-cathode fluorescent lamps is associated with a lamp current, and the second plurality of cold-cathode fluorescent lamps includes at least a fourth lamp. The fourth lamp is different from the each of the second plurality of cold-cathode fluorescent lamps and is associated with a second current. Additionally, a first current balancing device selected from the plurality of current balancing devices is configured to receive the lamp current and the second current and to balance the lamp current and the second current. Moreover, if the second plurality of cold-cathode fluorescent lamps further includes a fifth lamp which is different from the each of the second plurality of cold-cathode fluorescent lamps and is associated with a third current, a second current balancing device selected from the plurality of current balancing devices is configured to receive the lamp current, and the first current or the third current, and is further configured to balance the lamp current, and first current or the third current. For example, the system is implemented according to FIG. 4.

According to yet another embodiment of the present invention, a system for driving a plurality of cold-cathode fluorescent lamps includes a subsystem configured to receive at least a DC voltage and generate a first AC voltage in response to at least the DC voltage, a power converter configured to receive the first AC voltage and convert the first AC voltage to at least a second AC voltage, and a plurality of current balancing devices. Each of the plurality of current balancing devices is configured to receive two currents and balance the two currents. The power converter and the plurality of current balancing devices are capable of being directly or indirectly coupled to a plurality of cold-cathode fluorescent lamps. For each of the plurality of cold-cathode fluorescent lamps, each of the plurality of cold-cathode fluorescent lamps is associated with a first lamp current and a second lamp current, and the plurality of cold-cathode fluorescent lamps includes at least a first lamp and a second lamp. Both the first lamp and the second lamp are different from the each of the plurality of cold-cathode fluorescent lamps. The first lamp and the second lamp are associated with a third lamp current and a fourth lamp current respectively. Additionally, a first current balancing device selected from the plurality of current balancing devices is configured to receive the first lamp current and the third lamp current and to balance the first lamp current and the third lamp current, and a second current balancing device selected from the plurality of current balancing devices is configured to receive the second lamp current and the fourth lamp current and to balance the second lamp current and the fourth lamp current. For example, the system is implemented according to FIG. 2 and/or FIG. 6.

According to yet another embodiment, a method for driving a plurality of cold-cathode fluorescent lamps includes receiving at least a DC voltage, generating a first AC voltage in response to at least the DC voltage, receiving the first AC voltage, converting the first AC voltage to at least a second AC voltage, and driving a plurality of cold-cathode fluorescent lamps with at least the second AC voltage. For each of the plurality of cold-cathode fluorescent lamps, each of the plurality of cold-cathode fluorescent lamps is associated with a lamp current, and the plurality of cold-cathode fluorescent lamps includes at least a first lamp and a second lamp. Both the first lamp and the second lamp are different from the each of the plurality of cold-cathode fluorescent lamps, and the first lamp and the second lamp are associated with a first current and a second current respectively. Additionally, for the each of the plurality of cold-cathode fluorescent lamps, the method includes receiving the lamp current and the first current, balancing the lamp current and the first current, receiving the lamp current and the second current, and balancing the lamp current and the first current. For example, the method is performed according to FIG. 3, FIG. 5, and/or FIG. 7.

According to yet another embodiment, a method for driving a plurality of cold-cathode fluorescent lamps includes receiving at least a DC voltage, generating a first AC voltage in response to at least the DC voltage, receiving the first AC voltage, converting the first AC voltage to at least a second AC voltage, and driving a first plurality of cold-cathode fluorescent lamps with at least the second AC voltage. The first plurality of cold-cathode fluorescent lamps includes a second plurality of cold-cathode fluorescent lamps and a third lamp, and the third cold-cathode fluorescent lamp is associated with a first current. For each of the second plurality of cold-cathode fluorescent lamps, each of the second plurality of cold-cathode fluorescent lamps is associated with a lamp current, and the second plurality of cold-cathode fluorescent lamps includes at least a fourth lamp, which is different from the each of the second plurality of cold-cathode fluorescent lamps and is associated with a second current. Additionally, for the each of the second plurality of cold-cathode fluorescent lamps, the method includes receiving the lamp current and the second current, and balancing the lamp current and the second current. Moreover, if the second plurality of cold-cathode fluorescent lamps further includes a fifth lamp, which is different from the each of the second plurality of cold-cathode fluorescent lamps and is associated with a third current, the method includes receiving the lamp current, and the first current or the third current, and balancing the lamp current, and first current or the third current. For example, the method is performed according to FIG. 4.

According to yet another embodiment, a method for driving a plurality of cold-cathode fluorescent lamps includes receiving at least a DC voltage, generating a first AC voltage in response to at least the DC voltage, receiving the first AC voltage, converting the first AC voltage to at least a second AC voltage, and driving a plurality of cold-cathode fluorescent lamps with at least the second AC voltage. For each of the plurality of cold-cathode fluorescent lamps, each of the plurality of cold-cathode fluorescent lamps is associated with a first lamp current and a second lamp current, and the plurality of cold-cathode fluorescent lamps includes at least a first lamp and a second lamp. Both the first lamp and the second lamp are different from the each of the plurality of cold-cathode fluorescent lamps, and the first lamp and the second lamp are associated with a third lamp current and a fourth lamp current respectively. Additionally, for the each of the plurality of cold-cathode fluorescent lamps, the method includes receiving the first lamp current and the third lamp current, balancing the first lamp current and the third lamp current, receiving the second lamp current and the fourth lamp current, and balancing the second lamp current and the fourth lamp current. For example, the method is performed according to FIG. 2 and/or FIG. 6.

The present invention has various advantages. Some embodiments of the present invention provide a driver system that can balance currents between or among any number of lamps. Certain embodiments of the present invention provide a configuration in which only one or two inductive windings are in series with each lamp between the secondary winding of the transformer and the ground voltage. For example, the one or two inductive windings belong to one or two current balance chokes respectively. In another example, the currents flowing through at least majority of the lamps go through same types of circuit components. Some embodiments of the present invention provide great flexibility to the design and manufacturing of multi-lamp driver system. Certain embodiments of the present invention can improve stability and reliability of a multi-lamp driver system. Some embodiments of the present invention can simplify processes and lower costs for making a multi-lamp driver system. Certain embodiments of the present invention can balance both the currents flowing into some lamps and the currents flowing out of certain lamps. Some embodiments of the present invention can improve current balancing of a multi-lamp driver system by eliminating or reducing adverse effects by stray conductance or parasitic capacitance of the lamps. Certain embodiments of the present invention can provide current balancing to lamps driven by different transformers using cyclic current balance schemes. Some embodiments of the present invention can improve brightness uniformity on an LCD screen lit by a plurality of lamps that are driven by one or more transformers.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system for driving a plurality of cold-cathode fluorescent lamps, the system comprising:

a subsystem configured to receive at least a DC voltage and generate a first AC voltage in response to at least the DC voltage;

a power converter configured to receive the first AC voltage and convert the first AC voltage to at least a second AC voltage; and a plurality of current balancing devices;

wherein the power converter and the plurality of current balancing devices are configured to be directly or indirectly coupled to a plurality of cold-cathode fluorescent lamps including N fluorescent lamps;

wherein:

the plurality of cold-cathode fluorescent lamps includes a $1^{st}$ fluorescent lamp, a $2^{nd}$ fluorescent lamp, . . . , a (j−1)th fluorescent lamp, a jth fluorescent lamp, a (j+1)th fluorescent lamp, . . . , an (n−1)th fluorescent lamp, and an nth fluorescent lamp;

the $1^{st}$ fluorescent lamp, the $2^{nd}$ fluorescent lamp, . . . , the (j−1)th fluorescent lamp, the jth fluorescent lamp, the (j+1)th fluorescent lamp, . . . , the (n−1)th fluorescent lamp, and the nth fluorescent lamp are associated with a $1^{st}$ lamp current, a $2^{nd}$ lamp current, . . . , a (j−1)th lamp current, a jth lamp current, a (j+1)th lamp current, . . . , an (n−1)th lamp current, and an nth lamp current, respectively;

$n \geqq 3$; and $1<j<n$;

wherein:

each of the plurality of current balancing devices is configured to receive two currents and balance the two currents;

the plurality of current balancing devices are further configured to balance the $1^{st}$ lamp current and the $2^{nd}$ lamp current, . . . , the (j−1)th lamp current and the jth lamp current, the jth lamp current and the (j+1)th lamp current, . . . , the (n−1)th lamp current and the nth lamp current, and the nth lamp current and the $1^{st}$ lamp current, different pairs of currents being balanced by different current balancing devices;

wherein:

each of the plurality of current balancing devices includes a first winding and a second winding;

the first winding is in series with one of the plurality of cold-cathode fluorescent lamps; and the second winding is in series with another one of the plurality of cold-cathode fluorescent lamps.

2. The system of claim 1 wherein the $1^{st}$ lamp current, the $2^{nd}$ lamp current, . . . , the (j−1)th lamp current, the jth lamp current, the (j+1)th lamp current, . . . , the (n−1)th lamp current, and the nth lamp current are input currents flowing into the $1^{st}$ fluorescent lamp, the $2^{nd}$ fluorescent lamp, . . . , the (j−1)th fluorescent lamp, the jth fluorescent lamp, the (j+1)th fluorescent lamp, . . . , the (n−1)th fluorescent lamp, and the nth fluorescent lamp, respectively.

3. The system of claim 1 wherein the $1^{st}$ lamp current, the $2^{nd}$ lamp current, . . . , the (j−1)th lamp current, the jth lamp current, the (j+1)th lamp current, . . . , the (n−1)th lamp current, and the nth lamp current are output currents flowing out of the 1' fluorescent lamp, the $2^{nd}$ fluorescent lamp, the (j−1)th fluorescent lamp, the jth fluorescent lamp, the (j+1)th fluorescent lamp, . . . , the (n−1)th fluorescent lamp, and the nth fluorescent lamp, respectively.

4. The system of claim 1 wherein the power converter is further configured to drive the plurality of cold-cathode fluorescent lamps with at least the second AC voltage.

5. The system of claim 1 wherein the power converter is further configured to convert the first AC voltage to at least the second AC voltage and a third AC voltage.

6. The system of claim 5 wherein the power converter is further configured to drive the plurality of cold-cathode fluorescent lamps with at least the second AC voltage and the third AC voltage.

7. The system of claim 5 wherein the power converter includes at least a first transformer and a second transformer, the first transformer being configured to output the second AC voltage, the second transformer being configured to output the third AC voltage.

8. The system of claim 1 wherein the each of the plurality of current balancing devices is a current balance choke.

9. The system of claim 1, and further comprising a plurality of capacitors coupled to the power converter.

10. The system of claim 9 wherein the power converter is capable of being indirectly coupled to the plurality of cold-cathode fluorescent lamps through at least the plurality of capacitors.

11. The system of claim 1, and further comprising a current sensing feedback component coupled to the subsystem and configured to be coupled to at least one of the plurality of cold-cathode fluorescent lamps.

12. The system of claim 1 wherein the plurality of cold-cathode fluorescent lamps consists of an even number of cold-cathode fluorescent lamps.

13. The system of claim 1 wherein the plurality of cold-cathode fluorescent lamps consists of an odd number of cold-cathode fluorescent lamps.

14. A method for driving a plurality of cold-cathode fluorescent lamps, the method comprising:

receiving at least a DC voltage;

generating a first AC voltage in response to at least the DC voltage;

receiving the first AC voltage;

converting the first AC voltage to at least a second AC voltage;

driving a plurality of cold-cathode fluorescent lamps with at least the second AC voltage, the plurality of cold-cathode fluorescent lamps being associated with a plurality of lamp currents respectively;

balancing the plurality of lamp currents by a plurality of current balancing devices, each of the plurality of current balancing devices being configured to receive two currents and balance the two currents;

wherein:

the plurality of cold-cathode fluorescent lamps includes N fluorescent lamps;

the plurality of cold-cathode fluorescent lamps includes a $1^{st}$ fluorescent lamp, a $2^{nd}$ fluorescent lamp, . . . , a (j−1)th fluorescent lamp, a jth fluorescent lamp, a (j+1)th fluorescent lamp, . . . , an (n−1)th fluorescent lamp, and an nth fluorescent lamp;

the $1^{st}$ fluorescent lamp, the $2^{nd}$ fluorescent lamp, . . . , the (j−1)th fluorescent lamp, the jth fluorescent lamp, the (j+1)th fluorescent lamp, . . . , the (n−1)th fluorescent lamp, and the nth fluorescent lamp are associated with a $1^{st}$ lamp current, a $2^{nd}$ lamp current, . . . , a (j−1)th lamp current, a jth lamp current, a (j+1)th lamp current, . . . , an (n−1)th lamp current, and an nth lamp current, respectively;

$n \geqq 3$; and $1<j<n$;

wherein the process for balancing the plurality of lamp currents by the plurality of current balancing devices includes balancing the $1^{st}$ lamp current and the $2^{nd}$ lamp current, . . . , the (j−1)th lamp current and the jth lamp current, the jth lamp current and the (j+1)th lamp current, . . . , the (n−1)th lamp current and the nth lamp current, and the nth lamp current and the $1^{st}$ lamp current, different pairs of currents being balanced by different current balancing devices;

wherein:

each of the plurality of current balancing devices includes a first winding and a second winding; and the process for balancing the plurality of lamp currents by the plurality of current balancing devices includes balancing one of the plurality of lamp currents by at least the first winding and another one of the plurality of lamp currents by at least the second winding.

* * * * *